US005381084A

United States Patent [19]

Joshi et al.

[11] Patent Number: 5,381,084

[45] Date of Patent: Jan. 10, 1995

[54] ENCASEMENT FOR CIRCUIT HAVING PLURAL TRANSFORMERS

[75] Inventors: Shankar R. Joshi, Elmont, N.Y.; Meta Rohde, Upper Saddle River, N.J.

[73] Assignee: Synergy Microwave Corporation, Paterson, N.J.

[21] Appl. No.: 3,114

[22] Filed: Jan. 12, 1993

Related U.S. Application Data

[63] Continuation-in-part of Ser. No. 935,549, Aug. 26, 1992.

[51] Int. Cl.[6] ..... H01F 40/10

[52] U.S. Cl. ..... 323/361; 336/96; 174/52.2

[58] Field of Search ..... 336/96; 174/52 PE; 323/361; 332/172

[56] References Cited

U.S. PATENT DOCUMENTS

| | | | |
|---|---|---|---|
| 2,021,060 | 11/1935 | Hassel | 330/155 |
| 2,065,884 | 12/1936 | Braden | 330/166 |
| 2,075,683 | 3/1937 | Wheeler | 455/285 |
| 2,683,767 | 7/1954 | Cunningham | 174/52.2 |
| 3,238,472 | 3/1966 | Crompton-Couvela | 332/44 |
| 3,251,015 | 5/1966 | Denham | 336/96 |
| 3,699,394 | 10/1972 | Schuler | 174/52.2 |

FOREIGN PATENT DOCUMENTS

| | | | |
|---|---|---|---|
| 44-25018 | 10/1969 | Japan | 336/96 |

OTHER PUBLICATIONS

Surface Mount Technology, Feb. 1993, "Surface Mount Transformers: A New Packaging Approach," by Brad J. McCormick, pp. 27-31.

Ricon Resins, Inc., Material Safety Data Sheet, Ricotuff, Ricotuff L.V. Mixture/Part B, Jan. 1992.

Ricon Resins, Inc., New Product Bulletin, Ricotuff, Ricotuff L.V. and Ricotuff R.B., Jan. 1992.

*Primary Examiner*—Jeffrey L. Sterrett

*Attorney, Agent, or Firm*—Lerner, David, Littenberg, Krumholz & Mentlik

[57] ABSTRACT

A mass of dielectric material intimately surrounds a high frequency circuit having plural transformers in relative close proximity to one anther and provides mechanical stability and electrical protection to the circuit. The mass of dielectric material surrounding the circuit has a dielectric constant less than about 2.6 and a loss tangent less than about 0.009.

22 Claims, 10 Drawing Sheets

ENCASEMENT FOR CIRCUIT HAVING PLURAL TRANSFORMERS

CROSS-REFERENCE TO RELATED APPLICATION

This application is a continuation-in-part of application Ser. No. 07/935,549, filed Aug. 26, 1992.

BACKGROUND OF THE INVENTION

This invention relates to the encasement of electrical circuits having a plurality of transformers, and more specifically relates to embedding or potting such electrical circuits in a housing of a dielectric material. Furthermore, this invention relates to an improvement over the invention disclosed in our previously-filed application, Ser. No. 07/935,549, filed Aug. 26, 1992, which disclosure is hereby incorporated by reference herein.

As stated in earlier application, Ser. No. 07/935,549 (hereinafter the "'549 invention"), many transformers have cores which are toroid or balun shaped because of their capability of performing well in a large bandwidth and their ability to confine substantially all of the magnetic field within the toroid or balun itself. Not only is this efficient, but the confining of the electromagnetic field prevents undue electromagnetic interference to surrounding elements near the transformer. Preventing such interference is particularly important when the surrounding elements are themselves electromagnetic in nature. Thus, it is advantageous to prevent interference between transformers in the same circuit.

However, it is often difficult to affix a toroid structure transformer to a circuit board or other mounting means because it has no flat edges. A balun structure is also difficult to mount as well if the windings are disposed upon the only flat surfaces. Additionally, once a toroid or balun transformer is in place, its shape causes its point of connection with the circuit board to be mechanically unstable.

Arrangements have been proposed for preventing electromagnetic interference between elements. Hassel, U.S. Pat. No. 2,021,060, discloses that for the various transformers in each stage of an amplifier, it is desirable to avoid the electromagnetic coupling caused by leakage lines of force between the different transformers in the different stages. Hassel teaches that two well known ways of preventing such electromagnetic coupling are to shield the transformers or arrange their axes at right angles to each other. Other references which disclose shielding the transformers of different stages include Braden, U.S. Pat. No. 2,065,884, and Wheeler, U.S. Pat. No. 2,075,683.

The prior U.S. patent application, the '549 invention, discloses particularly advantageous transformer circuit arrangements which solve the above problems such as preventing unwanted electromagnetic coupling between transformers. Despite the '549 invention, however, there is still a present need to provide greater electrical insulation and protection from unwanted interference, particularly in extremely compact circuits having interactive electrical components such as transformers mounted in close proximity to one another, including the circuits described in the '549 invention. Moreover, it is desirable to provide increased insulation and mechanical stabilization to the circuit at a low cost without complicated and expensive circuit enclosure or shielding techniques.

There is also a need to solve sealing problems associated with such transformer circuits which are sometimes enclosed within a metallic cover that is soldered to the mounting or circuit panel. For such transformer circuits requiring a soldered seal between the mounting and the cover, unwanted solidification of molten solder in the form of small balls inside the enclosed circuit is a great concern to component manufacturers. Namely, while still in a molten state, solder applied to seal the cover to the mounting can inadvertently enter or leak into the inside of the enclosure through space between the cover and the mounting. This can occur, for example, when the solder does not adhere to the metallic surfaces because of dirt particles or from uneven heat distribution. Component manufactures are in a constant effort to overcome this solder ball problem.

Furthermore, it is also desirable to provide increased physical stability to the electronic components and wiring that comprise the circuit, for example in plural transformer circuits such as those disclosed in the '549 invention, where the transformers themselves may be partially affixed to a circuit board or mounting. Thus, the planar base of a transformer having a cylindrical elongated core may be attached to a circuit panel, although still further physical stabilization and protection from accidental movement or dislodgement would be desirable.

Moreover, especially in plural transformer circuits utilizing toroid or balun shaped transformers, it would be desirable to increase the stability of such transformers when disposed on the circuit panel to overcome the mounting difficulties associated therewith as described above.

It is further desirable in such plural transformer circuits, regardless of whether elongated, toroid or balun shaped cores are employed, to provide relatively inexpensive shielding utilizing fewer manufacturing steps. Such shielding should be provided not only between the transformers themselves, but to the entire circuit so as to insulate the circuit from surrounding components or other objects capable of generating unwanted interference.

In this regard, further improvements in the encasement of such plural transformer circuits are needed.

SUMMARY OF THE INVENTION

Accordingly, the present invention addresses these needs.

In one aspect of the present invention, a circuit comprises a mounting having a top surface; circuit elements including at least one transformer disposed on the top surface and electrical interconnection means for directing electrical signals through the transformers, the circuit elements being constructed and arranged to process signals in the frequency range of about 10–6000 MHz; and a mass of a dielectric material intimately surrounding the transformer and adhering to the mounting, the dielectric material at least partially supporting and protecting the transformer, the mass of dielectric material forming the entirety of an enclosure disposed on the top surface of the mounting, the dielectric material having a dielectric constant less than about 2.6 and a loss tangent less than about 0.009.

Desirably, the circuit elements include a first transformer having an elongated core with a longitudinal axis, and a second transformer having an elongated core with a longitudinal axis, and more desirably, the first and second transformers are positioned on the mounting such that the longitudinal axes of the elongated cores extend substantially parallel to one another.

Still further desirable, the first and second transformer each include an outer surface, and each of the elongated cores has a maximum width perpendicular to the longitudinal axes of the elongated cores, the maximum widths defining a pair measuring distance equal to the largest of the maximum widths; the first and second transformers being positioned on the mounting such that the shortest distance between the outer surface of the first core and the outer surface of the second core is about equal to greater than the pair measuring distance and about equal to or less than about twenty times the pair measuring distance.

According to other aspects of the present invention, the circuit elements may include transformers having balun or toroid shaped cores.

In another aspect of the present invention, the circuit further comprises input means for providing an input signal to the circuit elements and output means for providing an output signal derived from the input signal, the input means having a input impedance associated therewith and the output means having an output impedance associated therewith, the mounting further comprising a ground plane extending substantially parallel to the top surface and the circuit elements including at least one electrical signal carrying conductor connected to at least one of the input and output means, the signal carrying conductor substantially enclosed within the mass of dielectric material and extending above and substantially parallel to the ground plane to form a transmission line having a characteristic impedance to substantially match the input and output impedances. Desirably, the input, output and characteristic impedance have a substantially matched impedance falling within the range of 25 to 150 Ohms, and most desirably, is about 50 Ohms.

In yet another aspect of the present invention, the mass of dielectric material forms a generally rectangular block having a height, width, and depth, the block being disposed on the mounting, the height, width and depth each measuring generally less than or equal to 8 mm. In yet another aspect, the height and depth of the block measures generally less than or equal to 5 mm.

According to a further aspect of the present invention, the mounting is a circuit panel of the metallic type or of the insulating type. In another aspect of the present invention, the mounting is a ground plane.

In yet another aspect of the present invention, each transformer includes a top and bottom end, and the mounting includes a body, the mounting being provided with at least one recess extending into the body from the surface, a portion of the bottom end of each transformer being engaged in each recess.

In yet even another aspect, each recess extends only partially through said body of the mounting. Desirably, the body is a panel less than about 1 mm thick.

In yet a further aspect of the present invention, the circuit comprises a mounting having a top surface; circuit elements including at least one transformer disposed on the top surface and electrical interconnection means for directing electrical signals through the transformers, the circuit elements being constructed and arranged to process signals in the frequency range of about 10–6000 MHz; a mass of a dielectric material intimately surrounding the transformer and adhering to the top surface of the mounting, the dielectric material at least partially supporting and protecting the transformer, the dielectric material having a dielectric constant less than about 2.6 and a loss tangent less than about 0.009; and an insulating shell having an interior space therein, the shell being positioned on the top surface of the mounting and over the mass of dielectric material to enclose the mass of dielectric material and the transformer, the mass of dielectric material substantially filling all of the interior space of the shell.

These and other objects, features, and advantages of the present invention will be more readily apparent from the detailed description and the preferred embodiment set forth below, taken in conjunction with the accompanying drawings.

DETAILED DESCRIPTION OF THE PREFERRED EMBODIMENTS

Figure 1:
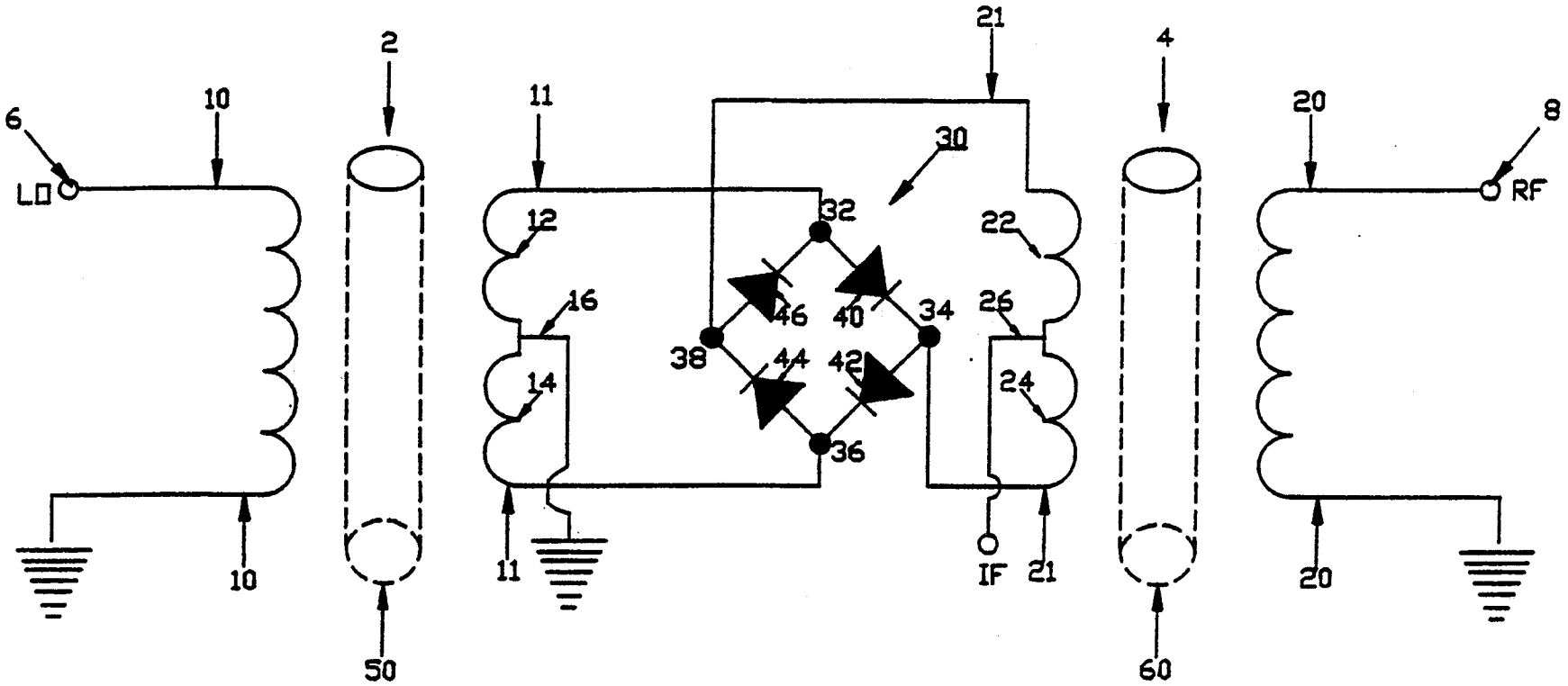
FIG. 1 is a schematic view of one circuit embodiment using transformers in accordance with the '549 invention.

FIG. 1 is a schematic view of one preferred circuit utilizing transformers in accordance with the '549 invention, namely, a double-balanced ring modulator for mixing a reference frequency with a local oscillating signal to create an intermediate frequency.

The mixer includes transformer 2, transformer 4, and diode ring 30. Transformer 2 has a primary winding 10 and a secondary winding 11 wrapped around core 50. One end of primary winding 10 is connected to ground, and the other end is connected to a local oscillator signal port 6. This port can accept a periodical oscillator signal within the frequency range of about 10 megahertz to 6 gigahertz. The primary winding 10 and each half of secondary winding 11 should have preferably two to four turns. The center tap 16 on secondary winding 11 is connected halfway between the top and bottom of the secondary winding, and is grounded. Thus, secondary winding 11 is a trifilar winding wrapped around core 50, the winding 11 is effectively divided into different halves, namely top half 12 and bottom half 14. Although the terms "primary" and "secondary" are used to refer to windings herein, the designation is merely for purposes of convenience. Either winding of the transformer could be used to accept an applied signal input or to provide an electrical signal output.

Similarly, transformer 4 includes primary winding 20 and secondary winding 21 wrapped around core 60. One end of primary winding 20 is connected to radio frequency port 8, and the other end of primary winding 20 is grounded. Primary winding 20 and each half of secondary winding 21 has preferably two to four turns. Further, secondary winding 21 has a center tap 26 which divides the winding into a top half 22 and a bottom half 24. The center tap 26 of secondary winding 21 is connected to intermediate frequency port 7.

Diode ring 30 is connected between the two transformers 2 and 4. Diode ring 30 includes four diodes 40, 42, 44, and 46 joined in series in a ring. Thus, the corners 32, 34, 36, and 38 of the diode ring 30 each adjoin the anode end of one diode and the cathode end of another diode. Preferably, the diodes are Schottky diodes. Each corner of the diode ring is connected to the top half or bottom half of one of the secondary windings of one of the transformers. Thus, the top half 12 of secondary winding 11 is connected to corner 32, and the bottom half 14 of secondary winding 11 is connected to the opposite corner 36. Similarly, the top half 22 of secondary winding 21 is connected to corner 38, and the bottom half 24 of secondary winding 21 is connected to the opposite corner 34. All the diodes 40, 42, 44, and 46 should be matched as closely to the others as possible, in terms of impedance and other performance characteristics.

Figure 2:
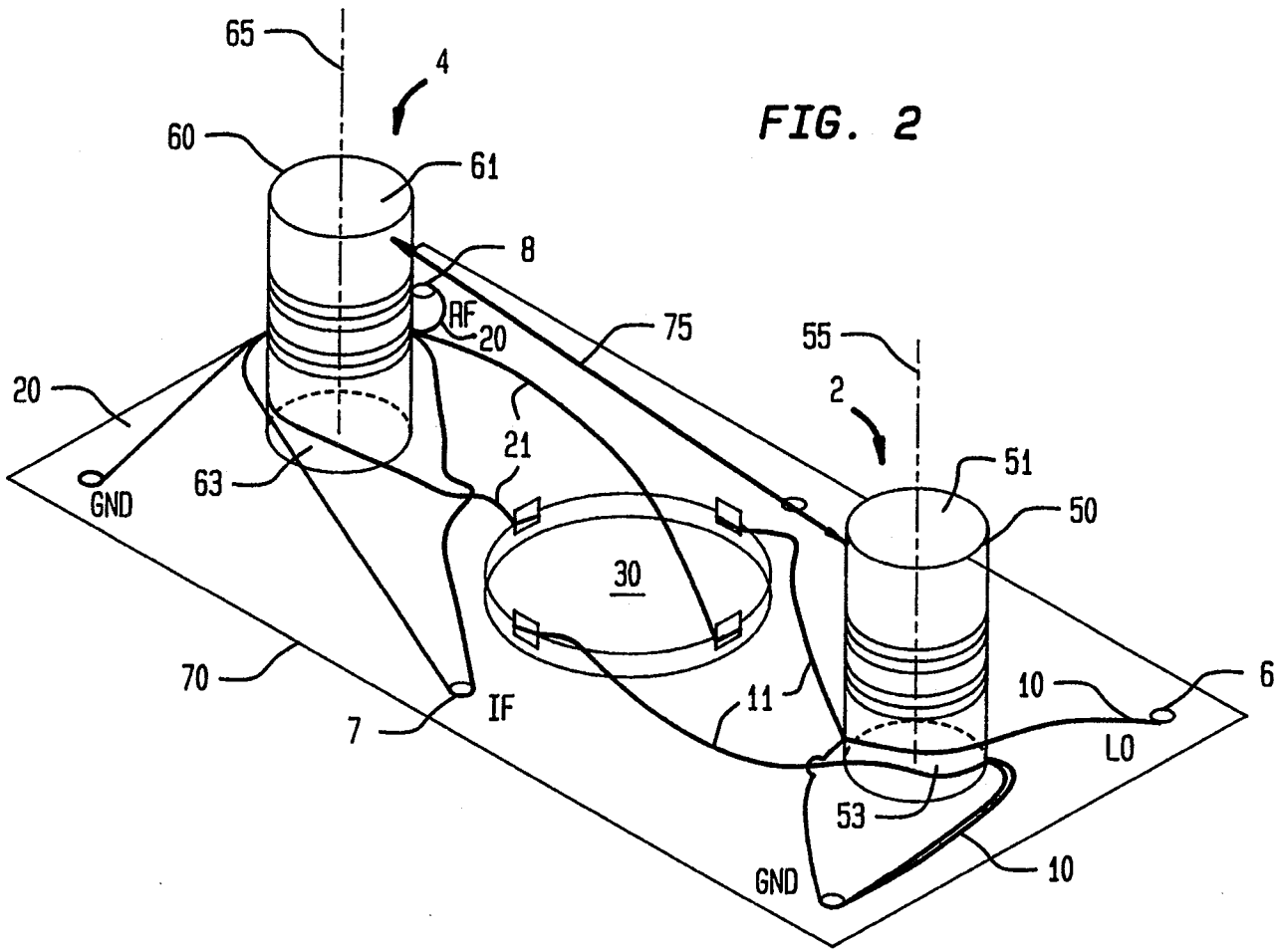
FIG. 2 is a three-dimensional view of a circuit in accordance with the '549 invention.

FIG. 2 represents a three-dimensional view of the mixer in accordance with the '549 invention showing the specific physical structure and orientation of the transformers. As can be seen, both core 50 of transformer 2 and core 60 of transformer 4 are cylindrical. Core 50 has a generally planar top end 51 and a generally planar bottom end 53. Core 60 has a similar top end 61 and bottom end 63. As shown, the primary windings 10 and 20 and secondary windings 11 and 21 are wrapped around the outer surface of their respective cores two times. The wires around the core may be in the form of insulated twisted pair wires, a printed metal pattern on flexible printed circuit board, or highly flexible cable. Preferably, both of the cores 50 and 60 are about 1 mm in diameter and of uniform diameter throughout their length.

Although the cores 50 and 60 are shown as being uniform circularly cylindrical cores, the cores could be of a different elongated shape. For instance, the elongated cores may have noncircular cross-sectional shapes, as may top and bottom ends 51, 53, 61 and 63, although sharp edges should be avoided.

The shape of the surface area of the cores is one factor which will determine the closest acceptable distance two elongated cores may be placed in proximity to one another while preventing excessive electromagnetic interference. This is so because flux linkage takes on the shape and size of the surface area of elongated cores. Each core has a maximum width perpendicular to the longitudinal axis between two cores. Together, the maximum widths of the cores cooperatively define a pair measuring distance, which can be used to determine the optimal spacing between the transformers. The pair measuring distance is equal to the larger of the maximum widths of the two cores. Thus, for the uniform circularly cylindrical cores shown in FIG. 2, the pair measuring distance will be equal to the diameter of one of the cores, whichever is larger. In the case where the two cores have equal maximum widths, the pair measuring distance is equal to either one of these widths.

Figure 5:
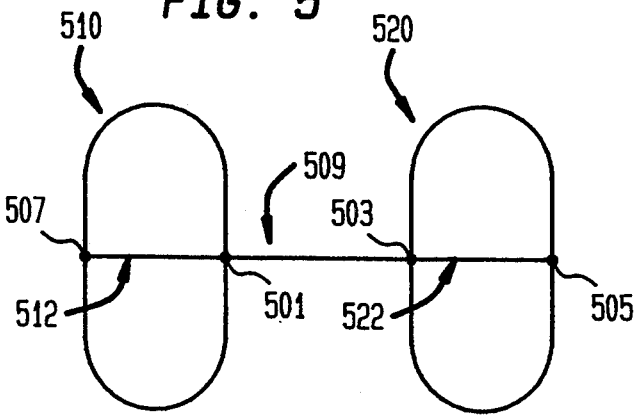
FIG. 5 is an illustration of two cores with a uniform elliptical cross-section in one particular orientation.

If the shape of the cores are not circular, the "width" of each core, and hence the pair measuring distance, will depend on the orientation of the cores with respect to one another. The position where the flux leakage of one core will first begin interfering with the flux linkage of another core will be somewhere on the line where the outer surface of one core is closest to the outer surface of the other core. For example, as shown in FIG. 5, the closest distance between the outer surfaces of the two cores 510 and 520 is the distance 509 between point 501 on core 510 and point 503 on core 520. The operative width, or "measuring width" of each core will be the width of the core along the line defined by the two closest points of the two cores, referred to herein as "the measuring line". In other words, the operative width 512 of core 510 is the distance between point 501 and point 507, both points lying along the measuring line. In other words, the measuring width of core 510 is the width of the core along the line defined by points 501 and points 503. Likewise, the measuring width 522 of core 520 is the distance between point 503 and point 505, which is the width of core 520 along the measuring line defined by point 501 and point 503. The pair measuring distance would be the larger of measuring width 512 of core 510 or measuring width 522 of core 520.

Figure 6:
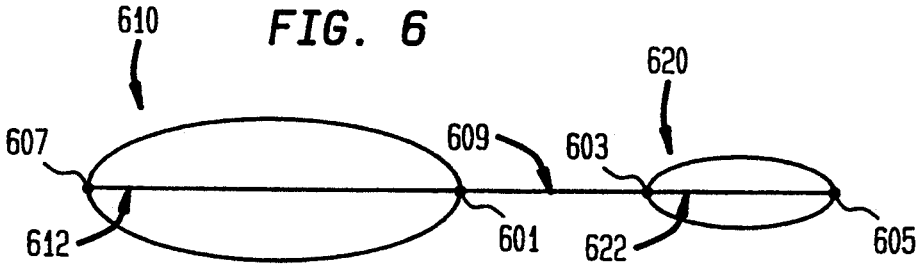
FIG. 6 is an illustration of two cores with a uniform elliptical cross-section in another particular orientation.

FIG. 6 illustrates another arrangement of non-circular cores. The two closest points between the two cores 610 and 620 are point 601 on core 610 and point 603 on core 620. The line 609 defined by points 601 and 603 is the measuring line and determines the measuring widths of the cores. The measuring width 612 of core 610 is the distance between point 601 and point 607, which is the width of core 610 along the measuring line defined by points 601 and 603. Likewise, the measuring width 622 of core 620 is the distance between point 603 and point 605, which is the width of core 620 along the measuring line defined by points 601 and 603. If the measuring width 612 of core 610 is greater than the measuring width 622 of core 620, then the pair measuring distance is equal to measuring width 612 of core 610.

The cores are preferably made of magnetically permeable material such as manganese zinc. The cores 50 and 60 are mounted on circuit panel 70 such that their longitudinal axes 55 and 65 are substantially parallel to one another. The planar bottom ends 53 and 63 of the cores abut the generally planar top surface 802 of circuit panel 70. In a preferred arrangement, small depressions or recesses are provided on top surface 802 of circuit panel 70 at areas corresponding to planar ends 53 and 63 of the cores in order to firmly retain the cores in their desired positions. The transformers are also mounted in spaced relation to each other, such that the shortest distance 75 between the outer surfaces of cores 50 and 60 is at least equal to the pair measuring distance. Given the parameters above, the distance 75 between the transformers is preferably more than or equal to 1.5 mm. However, the transformers are mounted at a distance less than about 20 times the pair measuring width, so that the overall assembly is still compact. In a highly practical arrangement, the distance between the cores should be between 1.3 times the pair measuring distance and 5 times the pair measuring distance, which, in a mixer, allows enough distance between the cores to place the diode ring between them, while still resulting in a compact unit. Optimally, the distance between the cores will be about 1.5 times the pair measuring distance.

In operation, electromagnetic interference between the transformers is substantially avoided by operating the transformers between 10 MHz to 6 GHz. For example, a 10 MHz to 6 GHz local oscillator (LO) signal is fed into port 6 across the primary winding 10 of the first transformer 2, as shown in FIG. 1. If the secondary winding has the same number of turns as the primary winding, the total voltage across the entire secondary winding will be approximately equal to the voltage across the primary winding, assuming that the primary and secondary terminating impedances are the same. However, assuming a positive cycle of the LO signal, the presence of grounded center tap 16 will force top half 12 of secondary winding 11 to be positive at the top, and grounded at the center tap. Thus, diode ring corner 32 will have a positive charge on a positive local oscillator cycle. Similarly, the bottom half 14 will be grounded at the top, and negative at the bottom. Therefore, diode ring corner 36 will have a negative charge on the positive cycle of the local oscillating signal. Due to a positive voltage at corner 32 and negative voltage at corner 36, diodes 40 and 42 will conduct, and diodes 44 and 46 will not. Thus, corner 38 is effectively isolated from the rest of the system, and no current can flow through the top half 22 of secondary winding 21. If the impedances of the halves 12 and 14 of secondary winding 11 are properly matched, and if the impedances of diodes 44 and 46 are properly matched, then the equal and opposite polarities at corners 32 and 36 will cause 34 to become effectively grounded. Thus, bottom half 24 of secondary winding 21 will be free to conduct. In sum, on a positive LO cycle, bottom half 24 of secondary winding will conduct and top half 22 will not.

On a negative cycle of the LO signal, the voltages on the windings and diode corners will be inverted. Thus, the top of top half 12 will be negative, as will be diode ring corner 32. Similarly, the bottom of bottom half 14 will be positive, as will be diode ring corner 36. Thus, on the negative LO cycle, diodes 44 and 46 will conduct and diodes 40 and 42 will not. Corner 34 will be effectively isolated from the system and no current may flow through bottom half 24 of secondary winding 21. As diode corner 34 was on the positive LO cycle, diode corner 38 will be at ground on the negative LO cycle. In sum, on a negative LO cycle, top half 22 of secondary winding 22 will conduct, and bottom half 24 will not.

Thus, the top and bottom halves of secondary winding 21 alternately conduct at the frequency set by the LO signal. This operation allows the mixing of a radio frequency (RF) signal impressed upon radio frequency port 8. When an RF signal is impressed across the primary winding 20, the corresponding electromagnetic field is translated into secondary winding 21 via core 60, and a corresponding signal is imposed within the secondary winding. The output of the mixer is the intermediate frequency (IF) port at center tap 26. As described above, the top half 22 and bottom half 24 of secondary winding 21 will alternate in conduction at a rate equal to the local oscillating signal. The current induced by the radio frequency signal in winding 21 will either flow toward or away from the center tap, depending upon which half of the secondary winding is conducting. Thus, the output or IF signal at port 7 will reflect the RF signal at port 8. Thus, the system mixes the signal at RF port 8 with the signal at LO port 6 to form the output or IF signal at port 7.

The above circuit can employ transformers with cylindrical cores in the above circuit. If the local oscillating frequency is between 10 MHz to 6 GHz, there will be little to no interference between the two transformers. Although this disclosure is not limited by any theory of operation, electromagnetic theory holds that the intensity of the magnetic flux at a given distance from an inductor decreases as the frequency of the current increases. In other words, at high frequencies, the magnetic flux generated by a transformer will remain relatively close to the core as compared to lower frequency signals. Therefore, the higher the frequency, the closer electromagnetically-sensitive objects may be placed to the transformer. This allows the two cylindrical cores to be used in close proximity to one another, without electromagnetic interference from one to the other. To further reduce the electromagnetic field outside the core, the core should be of a relatively small diameter, as the intensity of a magnetic field a given distance from a core will decrease as the diameter decreases.

Figure 3:
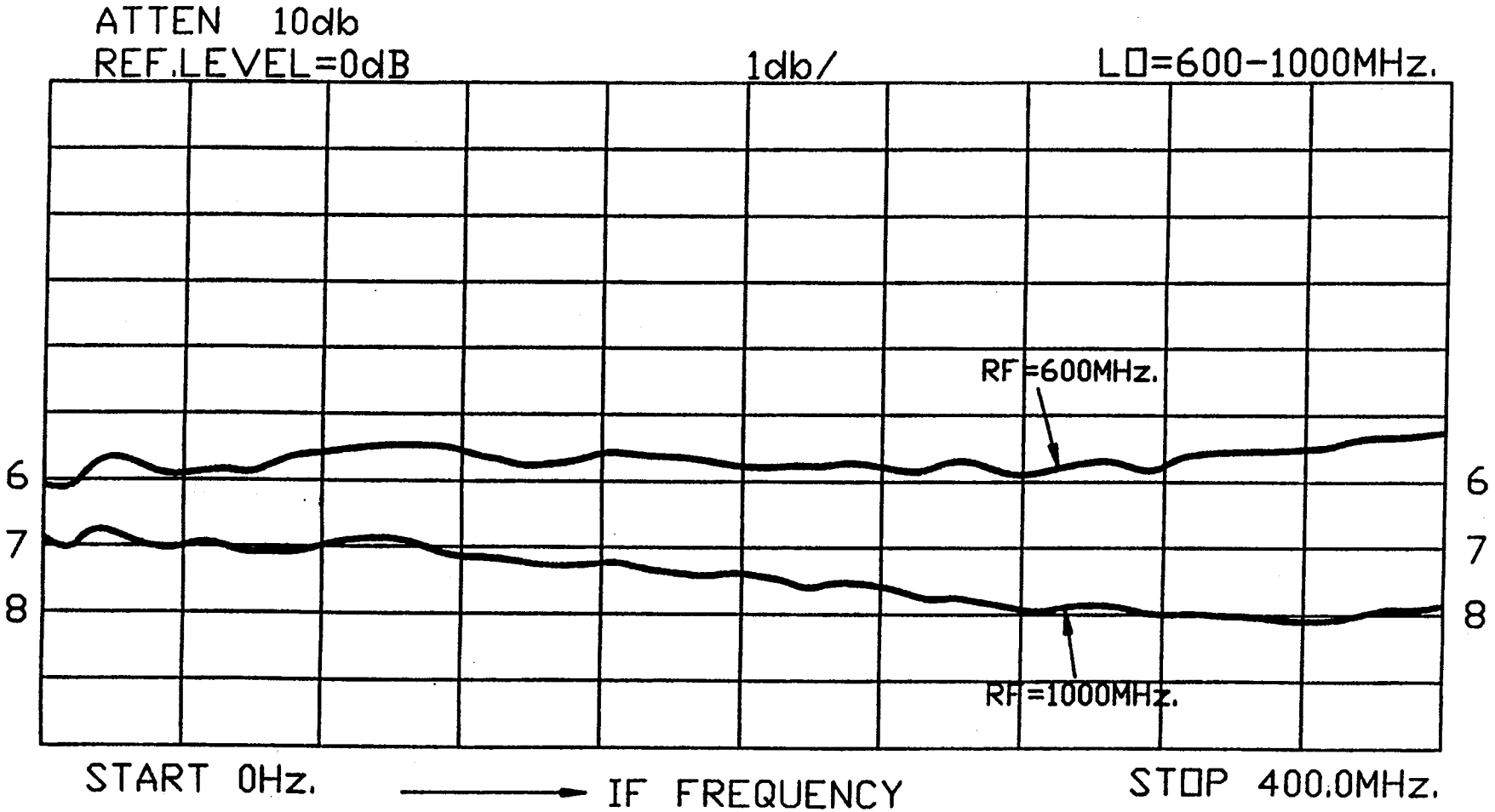
FIG. 3 is a graph of conversion loss versus frequency with two turns on each coil.
Figure 4:
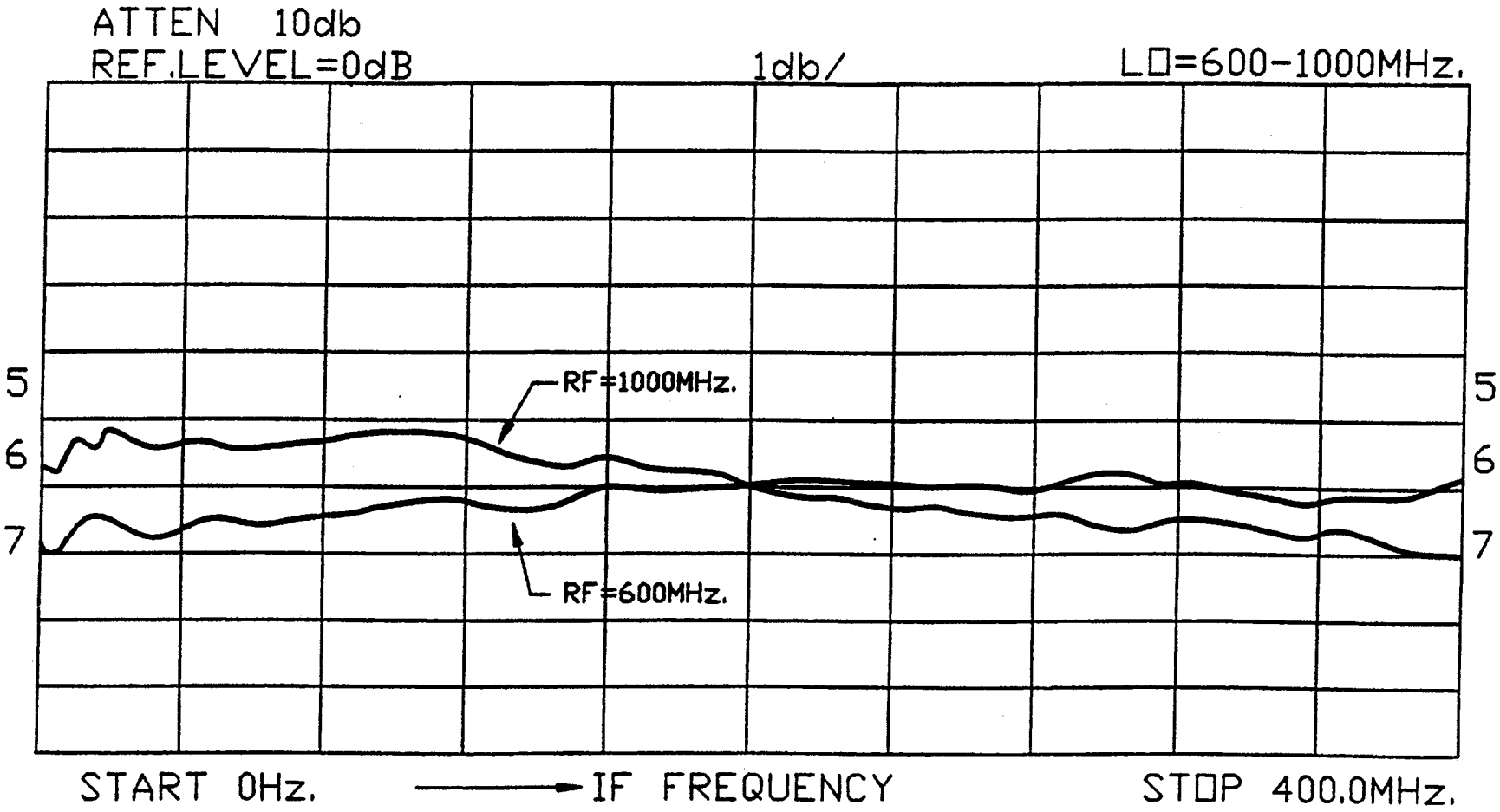
FIG. 4 is a graph of conversion loss versus frequency with three turns on each coil.

In order to promote a high performance, high frequency transformer circuit, it is preferable to avoid a large number of turns per winding on the core, as the upper frequency performance of a mixer is sacrificed as the number of turns increases. Specifically, the additional stray capacitance and self-inductance created by each extra turn of the winding impairs the performance of the transformer. FIG. 3 shows the performance of a mixer with the transformers having two turns of trifilar winding on each core, and FIG. 4 shows the performance of a transformer with three turns on each core. On each figure, the conversion loss of the mixer operating at two distinct radio frequencies, namely 600 MHz and 1000 MHz, is plotted over the range of intermediate frequencies created when the local oscillator signal is changed between 600 to 1000 MHz. By comparing FIG. 3 to FIG. 4, it can be seen that at higher frequencies, i.e., RF=1000 MHz, the conversion loss increases as the winding goes from 2 turns to 3 turns. In other words, as the number of turns increases, the conversion loss increases, and the performance decreases. However, at lower frequencies, i.e., RF=600 MHz, the conversion loss decreases by adding a turn to the winding, and therefore, the performance increases. In sum, the higher the operating frequency, the better the performance at lower number of turns per winding.

In essence, by striking a proper balance between the number of turns on the windings and frequency of operation, cylindrical core transformers may be used in close proximity to one another with excellent performance characteristics.

By experimentation, it has been found that by operating a plurality of transformers without potting with cylindrical cores in the frequency range or 10 MHz to 6 GHz, the transformers may be placed close to one another, as long as the distance between the cores remains greater than the pair measuring distance. For compactness, the distance should be as small as possible, and less than 20 times the pair measuring distance. A highly practical arrangement involves circularly uniform cylindrical transformers with windings having two to four turns, diameters of 1 mm, and the cores spaced no less than 1 mm apart, but no more than 20 mm apart, as measured between the exterior surfaces of the cores. This 1 mm spacing is sufficient to physically insert the diode ring between the two transformers. Thus, an extremely small mixer is created which can be manufactured at low cost and high efficiency.

It has been generally believed that cylindrical cores should be avoided for two reasons: their shape creates an electromagnetic field outside the core, and the electromagnetic leakage results in poor performance. Further, cylindrical cores have a relatively narrow bandwidth of good performance as compared to toroid or balun cores. Thus, balun and toroid cores have been used instead. However, the circuit arrangements of the '549 invention use cylindrical cores without undue interference or loss of performance. In fact, significant advantages are gained by using cylindrical cores over balun or toroid cores, especially when potting is not used in accordance with the present invention. First, a non-potted mixer with cylindrical cores can be up to 50 percent smaller in size than similar mixers with toroid or balun shaped cores operating in the same frequency range. Additionally, the minimum size for a toroid or balun core will be at least twice the diameter of the cylindrical cores. The smaller size of the present circuit results in less stray reactances, such as interwinding capacity and self inductance, because less wire is necessary to be wound around the smaller cylindrical cores compared to the toroid or balun cores. Second, production costs are also lower because of the ease in which cylindrical cores may be wound. For example, there is no need to wind a wire in and out of a hole, as is required with a toroid or balun core. This ease of winding makes the cylindrical core excellent for automation, and also reduces the chances of nicking a wire during winding. Third, grooves may be easily created on the outer surface of the core to hold the wires in place when critical accuracy is required. Such grooves are extremely expensive and impractical to create on balun and toroid cores. Fourth, since there is no hole in the cylindrical core, the cores can be attached to the support base first and wound later. Attaching the cores first and then winding allows machines to position the transformers on the board within the specific distance ranges disclosed earlier, without fear of damaging the fine wires. Fifth, once mounted, the cylindrical cores are highly mechanically stable because the cores are affixed at their flat ends. Toroid or balun cores must be wound before mounting, and usually lack a flat surface for attachment. Of course, the positioning and stability of cylindrical cores, as well as balun or toroid cores if so used, can be greatly enhanced when the same are embedded in the dielectric material as described further below.

Figure 7:
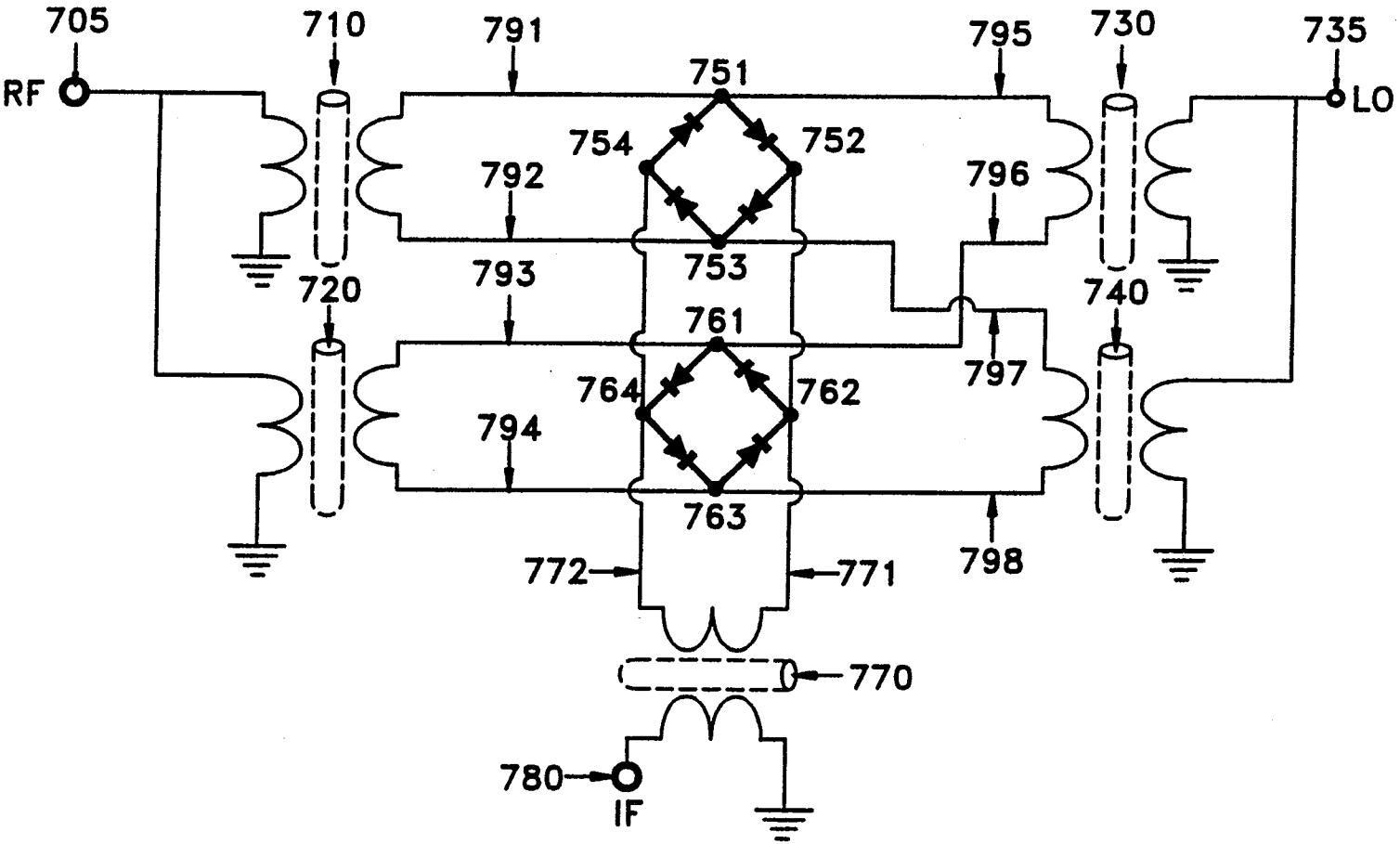
FIG. 7 is a schematic view of a triple-balanced mixer using transformers in accordance with the '549 invention.
Figure 8:
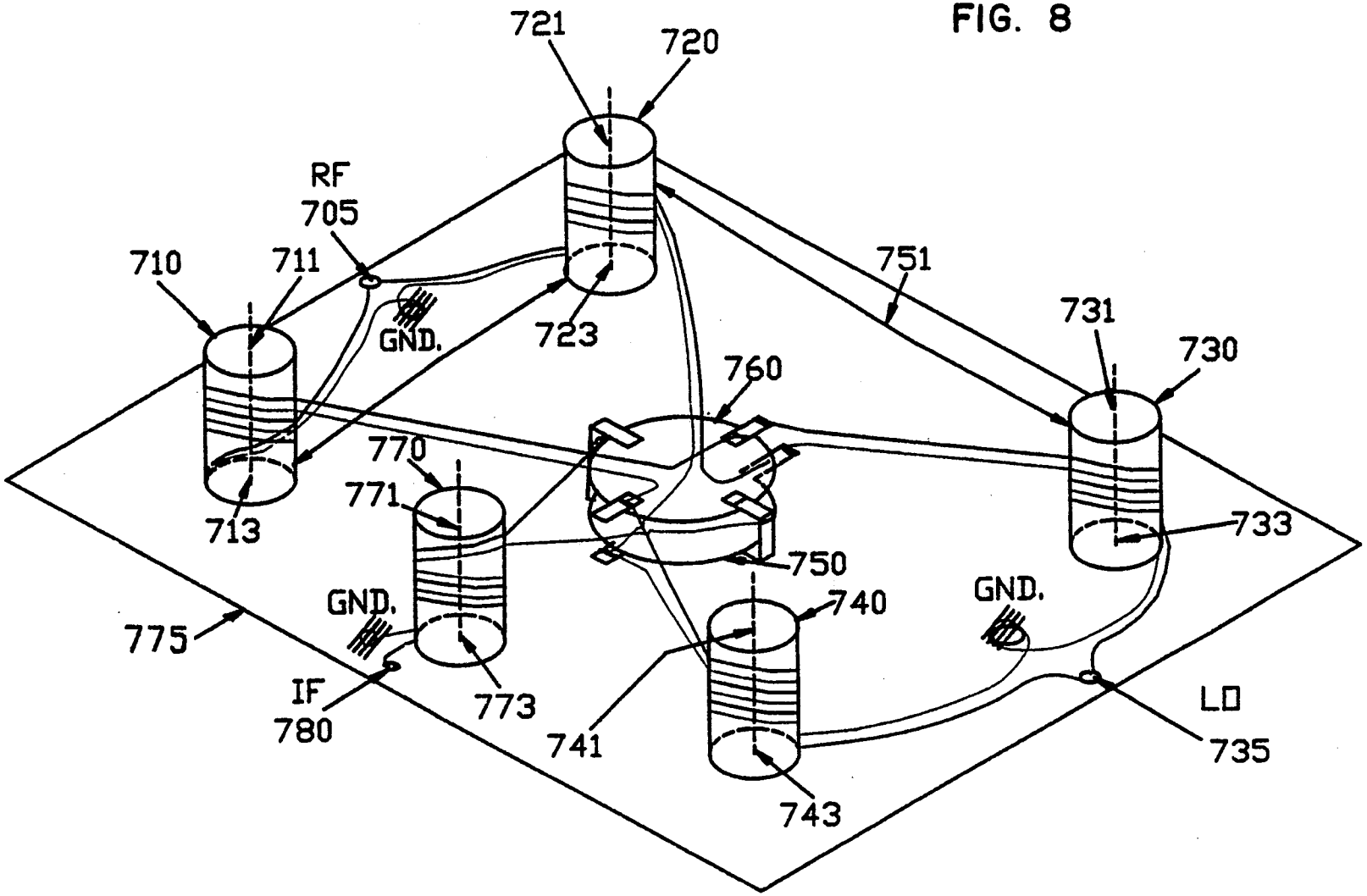
FIG. 8 is a three-dimensional view of another circuit using transformers in accordance with the '549 invention.

While the transformers herein are shown for use in a double-balanced mixer, they may be used in any circuit which has a plurality of electromagnetic sensitive elements. For example, as shown in FIGS. 7 and 8, a triple-balanced mixer has five transformers, combinations of which may be configured in accordance with the '549 invention. Each of the transformers is unbalanced on the signal or input side, and balanced towards the diode rings. Generally, triple balanced mixers have a higher frequency response compared to double balanced mixers.

The radio frequency (RF) portion of the mixer is derived by interconnecting two unbalanced to balanced transformers. Specifically, transformers 710 and 720 accept a radio frequency signal from RF port 705. Similarly, transformers 730 and 740 receive a local oscillator (LO) signal from LO port 735. The secondary windings of transformers 710, 720, 730, and 740 are connected to diode rings 750 and 760. Thus, the balanced ports 791 and 792 from RF transformer 710 are connected to opposite corners 751 and 753, respectively, of diode ring 750, and balanced ports 793 and 794 from RF transformer 720 are connected to opposite corners 761 and 763, respectively, of diode ring 760. The balanced ports from the LO portion of the mixer are also connected to the corners of the diode rings, such that balanced port 795 from LO transformer 730 and the balanced port 797 from LO transformer 740 are connected to opposite corners 751 and 753, and such that the balanced port 796 from LO transformer 730 and the balanced port 798 from LO transformer 740 are connected to opposite corners 761 and 763.

The two diode rings 750 and 760 are interconnected such that corner 752 of diode ring 750 is connected to corner 762 of diode ring 760, and corner 754 of diode ring 750 is connected to corner 764 of diode ring 760. The balanced ports, namely 771 and 772 of transformer 710 are connected to the above diode junction from which the intermediate frequency (IF) signal is outputted at port 780.

As can be seen from FIG. 8, all the cores of transformers 710, 720, 730, 740 and 770 are uniformly circularly cylindrical, having planar top ends 711, 721, 731, 741 and 771, respectively, and being attached to the mounting board 775 at planar bottom ends 712, 722, 732, 742 and 772, respectively. As discussed above, the cores may conform to other elongated shapes.

Electromagnetic interference between the transformers of RF port 705, LO port 735 and IF port 780 is undesirable, and should be avoided. Thus, the distance from the outer surfaces of transformer 710 and transformer 730 should be no less than the pair measuring distance as defined by the size and shape of the transformers and as discussed above. Likewise, the distance between transformer 710 and transformer 740 should be no less than the pair measuring distance defined by the transformers 710 and 740, the distance between transformer 720 and transformer 730 should be no less than the pair measuring distance defined by the transformers 720 and 730, and the distance between transformer 720 and transformer 740 should be no less than the pair measuring distance defined by the transformers 720 and 740. As transformers 710 and 720 receive and output the same signal, electromagnetic interference between transformers 710 and 720 is insignificant, and the transformers may be any distance apart. For the same reasons, the distance between transformers 730 and 740 may be of any length.

Further, the distance between IF transformer 770 and any other transformer, namely, transformers 710, 720, 730 and 740, should be greater than or equal to the pair measuring distance, as defined by the IF transformer and the other transformers from which transformer 770 is spaced.

The disclosed embodiments are useful in circuits beyond mixers, as well. This configuration of transformers could be used in any circuit where it is desirable to prevent electromagnetic interference between two or more transformers. In fact, the described circuit arrangements are particularly suited for use in modulators, which are essentially a combination of mixers and power dividers, and have a multitude of transformers. As it is often highly advantageous to make a modulator as small as possible, such as in cellular phones, the described circuits are uniquely directed to the combined goals of high performance and miniature size. Such transformers as described may be used in other circuits as well, such as amplifiers, single balanced mixers, couplers, phase shifters, phase detectors, and limiters.

Figure 9:
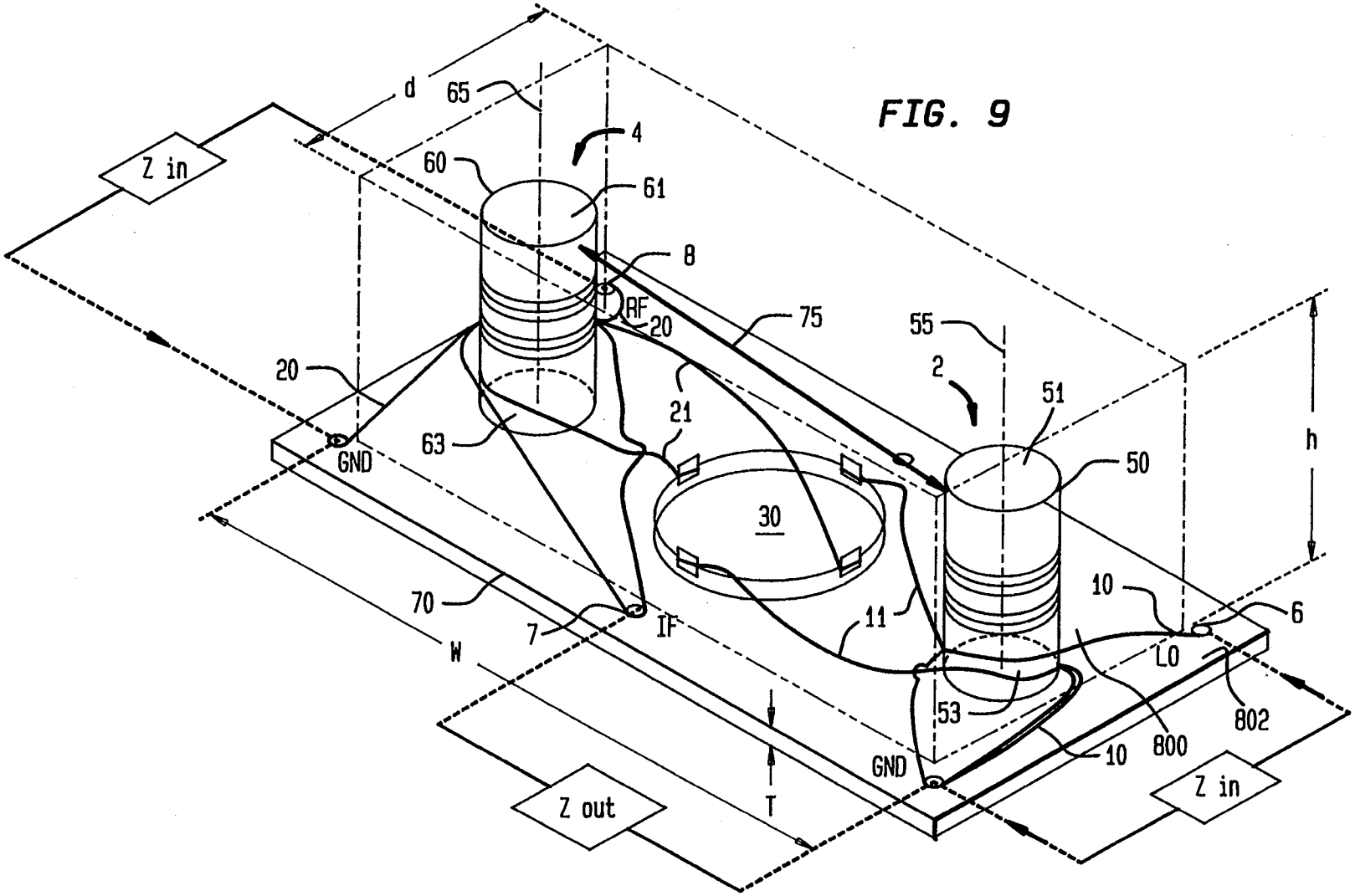
FIG. 9 is a diagrammatic perspective view of a circuit in accordance with an embodiment of the present invention.

Turning now to FIG. 9, the circuit of FIG. 2 is shown after being encased or "potted" in a mass of dielectric material 800. The mass of dielectric material 800 is formed by applying the material directly to top surface 802 of circuit panel 70 so as to completely and intimately surround the electrical components thereon, including transformers 2 and 4, diode ring 30, and windings 10, 11, 20, and 21. Circuit panel 70 is preferably a circuit board having a preferred thickness T of about 0.6 mm and can be fabricated from a metallic material or an insulating-type material such as alumina (ceramic), an epoxy laminate, or bonded fiberglass. Circuit panel 70 can be constructed and arranged in various ways to initially secure and hold in place elongated cores 50 and 60 of transformers 2 and 4. For example, small depressions or recesses can be provided on top surface 802 of circuit panel 70 at the areas corresponding to planar bottom ends 53 and 63 of cores 50 and 60. In this manner, cores 50 and 60 can be initially located on circuit panel 70, retained firmly in their desired positions. Permanent fixation to top surface 802 of circuit panel 70 would then occur after the entire circuit was embedded in dielectric material 800. This mounting approach is highly advantageous when used with extremely small plural transformer circuits including those employing elongated cores in that it avoids the need for complicated, time-consuming, and costly fastening techniques of these cores and other circuit elements to the circuit panel such as by clamping each transformer to the panel or the like. Furthermore, in another fastening technique in accordance with the present invention, small depressions in circuit panel 70 need not even be formed in that the circuit elements can first be placed in their proper locations and firmly attached using a proper glue on the circuit panel and then the circuit can be embedded with dielectric material 800 to thereby affix such circuit elements to circuit panel 70.

As noted, such encasing with the mass of dielectric material in accordance with the present invention need not be limited solely to elongated core transformer circuits as disclosed in the '549 invention, although this is the preferred embodiment. Thus, the present invention is also applicable to circuits having balun or toroid core transformers which is especially advantageous in that it greatly reduces the difficulties associated with mounting such potentially unstable transformers by encasing such transformers within the mass of dielectric to secure and mount the same to the circuit panel.

Yet another advantage that follows from employing the dielectric material in accordance with the present invention is that it provides superior mechanical stability not only to transformers 2 and 4, but also to the suspended wires that lead to and from windings 10, 11, 20 and 21 on cores 50 and 60. This is significant because the wires that lead to and from these windings would otherwise partially suspend over top surface 802 of circuit panel 70 if the circuit was not potted in accordance with the instant invention. Thus, application of dielectric material 800 stabilizes and protects formerly loose wires and protruding components such as transformers 2 and 4 from any accidental displacement or damage thereto.

Yet a further advantage obtained by employing dielectric material in accordance with the present invention is the reduction of losses in the circuit by the creation of a transmission line having a matchable impedance. Namely, when circuit panel 70 incorporates, or itself operates as a ground plane, the suspended wires leading to and from windings 10, 11, 20, and 21 on cores 50 and 60, when housed in dielectric material 800 and located above the ground plane, form a transmission line having a characteristic impedance ($Z_o$) determined by distributed inductance and capacitance. In this manner, losses from this transmission line may be controlled and minimized through matching to source ($Z_{in}$) and/or load impedance ($Z_{out}$), as the case may be, by varying the wire diameter and spacing between the wire and the ground plane. In this regard, employing the dielectric material to encase the wires to create an impedance-matchable transmission line is therefore highly advantageous over using lossy wires alone suspended over a ground plane. By design, the source impedance ($Z_{in}$), load impedance ($Z_{out}$), and the characteristic impedance ($Z_o$) of the transmission line (collectively referred to as the "system impedance") are all substantially matched to one another to minimize circuit losses. In preferred arrangements, this system impedance will have typical value in the range of 25–150 Ohms, and more preferably will be either 50 or 75 Ohms.

Figure 10:
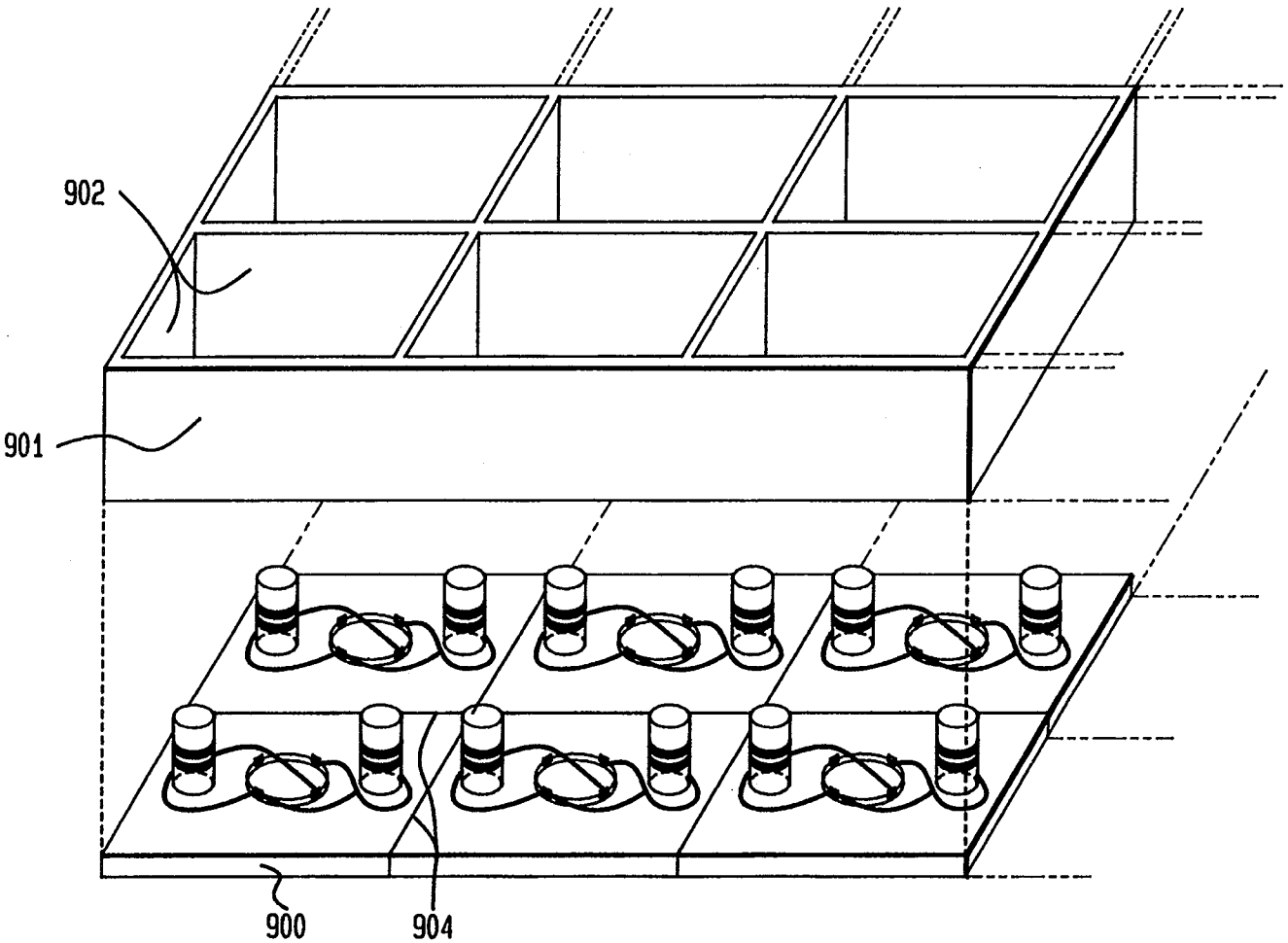
FIG. 10 is a three-dimensional view of a plurality of adjacent circuits in accordance with the '549 invention along with a mold for placement thereover in accordance with the present invention.

In forming the finished and encased circuit, dielectric material 800 can be placed directly on the circuit itself for adhesion to the circuit elements and top surface 802 of circuit panel 70 using conventional potting techniques. Referring now to FIG. 10, the preferable technique, however, is to embed numerous miniature circuits simultaneously. In this manner, for example, a large matrix such as 40 by 40 matrix of individual circuits arranged side-by-side is formed on a single large panel 900 while a mold 901 arranged as grid of perpendicular retaining border walls that surround each individual circuit is placed over the matrix of circuits. After coating inner walls 902 of the mold with a mold-release material that will generally not adhere to the dielectric material, the dielectric material is poured into mold 901 while in a flowable state. Once the dielectric material has sufficiently adhered to large circuit panel 900 and has hardened (after baking at a given temperature and time), mold 901 is then removed and the individually potted circuits are then separated from one another by breaking large panel 900 along score lines 904.

It is noted that once the dielectric material has set in place on the circuit, there is no hollow space left within the mass 800. Namely, the material forms as a solid mass on circuit panel 70 such that mass of dielectric material 800 not only encloses the circuit, but it substantially completely fills all interior space around the components while at the same time bonding to circuit panel 70 and the circuit elements thereon. This technique is most advantageous in that it hermetically seals the entire circuit from the outside environment and other components nearby that can cause unwanted interference with the circuit. Moreover, such encasing is relatively inexpensive as compared to providing a hollow covering having the same or similar dimensions as the mass of the dielectric material 800 (such as a metallic shell enclosure that would have to be additionally soldered to the circuit panel to provide a hermetic seal thereto) over each individual circuit in order to supply the requisite protection and shielding. Thus, with the encased circuit of the present invention, the dielectric material not only provides physical stability to the components and allows for relatively cost-effective and uncomplicated mounting techniques, but it also serves as a stand-alone hermetically insulating shell or shielding cover for the circuit itself. With one preferred circuit arrangement of the '549 invention useful in applications such as a modulator for cellular phones, the preferred dimensions of the mass of dielectric material 800 once formed on top surface 802 of circuit panel 70 corresponding to height (h), width (w), and depth (d) (see FIG. 9) are approximately h, w, and d generally less than or equal to about 7.5 mm. More preferably, the dimensions are approximately h=4 mm, w=5 mm, and d=5 mm. These dimensions of course will vary with the dimensions of the circuit and corresponding circuit panel employed such that the dielectric material substantially encases the circuit constructed on the circuit panel.

Figure 11:
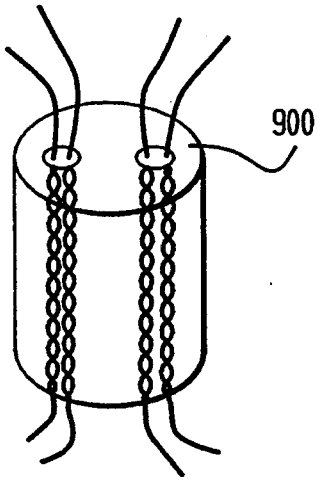
FIG. 11 is an illustration of transformer having a balun shaped core.
Figure 12:
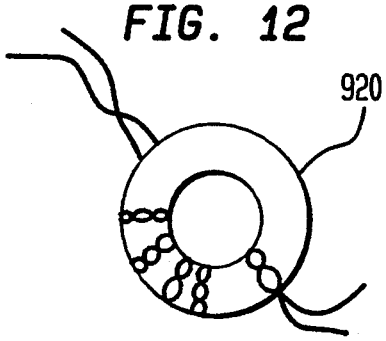
FIG. 12 is an illustration of transformer having a toroid shaped core.

FIGS. 11 and 12 illustrate transformers having cores that are balun shaped and toroid shaped, respectively. Thus, in accordance with one aspect of the present invention, balun core transformers 900 (FIG. 11) or toroid core transformers 920 (FIG. 12) can be used in high frequency circuits, such as those described in the '549 invention and herein, in place of transformers having elongated cores. Although previously the use of such balun and toroid transformers has been problematic due to their mechanical instability when mounted on the circuit panel because of a lack of a flat mounting surface, no longer is such the case. The present invention solves this problem by providing dielectric material to substantially completely encase and surround the circuit elements including the transformers, no matter what the shape the cores may be, to provide the requisite mounting stability and protection to these transformers that were heretofore difficult to mount.

Figure 13:
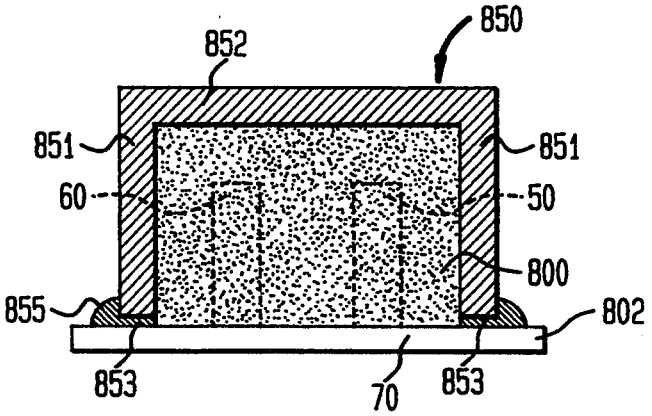
FIG. 13 is a cross-sectional view of another circuit embodiment in accordance with the present invention.

Turning now to FIG. 13, although in a preferred embodiment dielectric material 800 can be employed as the sole encasing for the circuit, an additional insulating shell 850 may be added to further shield the circuit for applications requiring such added protection. Accordingly, in a preferred embodiment, shell 850 has side walls 851 (consisting of four opposed walls at right angles when the shell is rectangular), that extend around the side faces of dielectric material 800, and top wall 852 which extends over the top surface of dielectric material 800 such that dielectric material 800 nearly or completely fills the interior of shell 850. Underneath side walls 851 is mounting surface 853 that contacts top surface 802 of circuit panel 70 when shell 850 is seated over the circuit.

Shell 850 can be constructed from a variety of insulating materials but preferably is metallic such that it can be soldered to circuit panel 70, which can also be metallic as described above. An important advantage that follows from employing dielectric material 800 in conjunction with shell 850 is that it prevents the introduction of "solder balls" inside shell 850 that can form when the shell is soldered to the circuit panel to provide a hermetic seal thereto. Namely, if shell 850 is placed over the circuit without dielectric material 800 therein, a gap or space will be left under shell 850 such that any molten solder applied to seal shell 850 to the circuit panel can potentially flow into the enclosed circuit. This can occur, for example, when the molten solder solidifies without adhering to the metallic surface due to a dirty condition or uneven heat distribution. This problem, however, can be solved with the present invention which eliminates this free space within shell 852. Thus, in one method of constructing the circuit shown in FIG. 13, shell 850 is first placed over dielectric material 800 and then soldered in place to top surface 802 of circuit panel 70 about the shell's periphery along mounting surface 853 below side walls 851. In this manner, the solder 855 cannot be drawn into shell 850 (i.e., the enclosed circuit) and form solder balls since dielectric material 800 occupies all the free space thereunder.

The material used to pot or encase the circuit is preferably an epoxy resin having the requisite characteristics including electrical and mechanical properties that provide a low loss tangent, a low dielectric constant, strong adhesion to the circuit board and electrical components thereon, and sufficient tensile strength and density to mechanically stabilize the components and wiring of the circuit. Preferably, such material is an epoxy resin such as Ricotuff, Ricotuff LV, Ricotuff RB, or a combination thereof, manufactured by Ricon Resins, Inc., of Grand Junction, Colo. More preferably, the material used is Ricotuff LV at low viscosity. From preliminary calculations provided by the manufacturer using frequencies between the range of about 12.5 to 18 GHz, this material is believed to generally have a dielectric constant between the values of 2.560 and 2.570 at normal viscosity and between 2.540 and 2.545 at low viscosity. At the same frequency range, the loss tangent is between 0.0107 and 0.0127 at normal viscosity and between 0.0087 and 0.0097 at low viscosity. It is preferable, in accordance with the present invention, to have a dielectric constant that is less than about 2.6 and a loss tangent of about 0.009, with relatively minor variations in both these values within a broad frequency range on the GHz order.

It should be further understood that the embedding techniques as disclosed in the instant invention may be applied to other high frequency transformer circuit arrangements (such as those employing balun or toroid shaped transformers), including but not limited to those preferred circuits described herein, and in particular, those circuits of FIGS. 1, 2, 7 and 8.

As these and other variations and combination of the features described above can be utilized without departing from the present invention as defined in the appended claims, the foregoing description of the preferred embodiment should be understood as being illustrative rather than as limiting the invention as defined in the claims.

We claim:

1. A circuit comprising:

(a) a mounting having a top surface;

(b) circuit elements comprising a first and second transformer each having an elongated core, said first and second transformers being disposed on said top surface and electrical interconnection means for directing electrical signals through said first and second transformers, said elongated cores of said first and second transformers having longitudinal axes, said first and second transformers being positioned on said mounting such that said longitudinal axes of said elongated cores extend substantially parallel to one another, said first and second transformer each including an outer surface, and each of said elongated cores having a maximum width perpendicular to said longitudinal axes of said elongated cores, said maximum widths defining a pair measuring distance equal to the largest of said maximum widths, said first and second transformers being positioned on said mounting such that the shortest distance between said outer surface of said first core and said outer surface of said second core is about equal to greater than said pair measuring distance and about equal to or less than about twenty times said pair measuring distance, said circuit elements being constructed and arranged to process signals in the frequency range of about 10–6000 MHz; and (c) a mass of a dielectric material intimately surrounding said transformer and adhering to said top surface of said mounting, said dielectric material at least partially supporting and protecting said transformer, said mass of dielectric material forming the entirety of an enclosure disposed on said top surface of said mounting, said dielectric material having a dielectric constant less than about 2.6 and a loss tangent less than about 0.009.

2. The circuit of claim 1, wherein said mass of dielectric material forms a generally rectangular block having a height, width, and depth, said block being disposed on said mounting, said height, width and depth each measuring generally less than or equal to 8 mm.

3. The circuit of claim 2, wherein said height and said depth of said block measures generally less than or equal to 5 mm.

4. The circuit of claim 1, wherein said mounting is a metallic circuit panel.

5. The circuit of claim 1, wherein said mounting is an insulating type circuit panel.

6. The circuit of claim 1, further comprising an insulating shell having an interior space therein, said shell being positioned on said top surface of said mounting and over said mass of dielectric material to enclose said mass of dielectric material and said transformers, said mass of dielectric material substantially filling all of said interior space of said shell.

7. A circuit comprising:

(a) a mounting having a top surface;

(b) circuit elements including at least one transformer disposed on said top surface and electrical interconnection means for directing electrical signals through at least one transformer, said circuit elements being constructed and arranged to process signals in the frequency range of about 10–6000 MHz; and (c) a mass of a dielectric material intimately surrounding said transformer and adhering to said top surface of said mounting, said dielectric material at least partially supporting and protecting said transformer, said mass of dielectric material forming the entirety of an enclosure disposed on said top surface of said mounting, said dielectric material having a dielectric constant less than about 2.6 and a loss tangent less than about 0.009, said circuit further comprising input means for providing an input signal to said circuit elements and output means for providing an output signal derived from said input signal, said input means having a input impedance associated therewith and said output means having an output impedance associated therewith, said mounting further comprising a ground plane extending substantially parallel to said top surface and said circuit elements including at least one electrical signal carrying conductor substantially enclosed within said mass of dielectric material and extending above and substantially parallel to said ground plane to form a transmission line having a characteristic impedance to substantially match said input and output impedances.

8. The circuit of claim 7, wherein said input impedance, said output impedance, and said characteristic impedance have a substantially matched impedance falling within the range of 25 to 150 Ohms.

9. The circuit of claim 7, wherein said input impedance, said output impedance, and said characteristic have a substantially matched impedance of about 50 Ohms.

10. The circuit of claim 7, wherein said mounting is a ground plane.

11. The circuit of claim 7, further comprising an insulating shell having an interior space therein, said shell being positioned on said top surface of said mounting and over said mass of dielectric material to enclose said mass of dielectric material and said at least one transformer, said mass of dielectric material substantially filling all of said interior space of said shell.

12. A circuit comprising:

(a) a mounting having a top surface;

(b) circuit elements including at least one transformer disposed on said top surface and electrical interconnection means for directing electrical signals through said at least one transformer, said circuit elements being constructed and arranged to process signals in the frequency range of about 10–6000 MHz, each said transformer including a top and bottom end, and said mounting including a body, said mounting being provided with at least one recess extending into said body from said surface, a portion of said bottom end of said each transformer being engaged in said each recess, and (c) a mass of a dielectric material intimately surrounding said transformer and adhering to said top surface of said mounting, said dielectric material at least partially supporting and protecting said transformer, said mass of dielectric material forming the entirety of an enclosure disposed on said top surface of said mounting, said dielectric material having a dielectric constant less than about 2.6 and a loss tangent less than about 0.009.

13. The circuit of claim 12, further comprising an insulating shell having an interior space therein, said shell being positioned on said top surface of said mounting and over said mass of dielectric material to enclose said mass of dielectric material and said at least one transformer, said mass of dielectric material substantially filling all of said interior space of said shell.

14. The circuit of claim 12, wherein said circuit elements include at least one transformer having an elongated core.

15. The circuit of claim 14, wherein said mounting is an insulating type circuit panel.

16. The circuit of claim 12, wherein said each recess extends only partially through said body of said mounting.

17. The circuit of claim 12, wherein said body is a panel less than about 1 mm thick.

18. The circuit of claim 12, wherein said circuit elements include at least one transformer having a toroid shaped core.

19. The circuit of claim 12, wherein said mass of dielectric material forms a generally rectangular block having a height, width, and depth, said block being disposed on said mounting, said height, width and depth each measuring generally less than or equal to 8 mm.

20. The circuit of claim 19, wherein said height and said depth of said block measures generally less than or equal to 5 mm.

21. The circuit of claim 12, wherein said mounting is a metallic circuit panel.

22. The circuit of claim 12, wherein said circuit elements include at least one transformer having a balun shaped core.

* * * * *